United States Patent [19]

Usui

[11] Patent Number: 4,996,961

[45] Date of Patent: Mar. 5, 1991

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 463,516

[22] Filed: Jan. 11, 1990

[30] Foreign Application Priority Data

Jan. 13, 1989 [JP] Japan ..... 1-2147[U]

[51] Int. Cl.[5] ..... F02M 39/00

[52] U.S. Cl. ..... 123/456; 123/470

[58] Field of Search ..... 123/456, 470, 471, 472; 137/561 R, 561 A

[56] References Cited

U.S. PATENT DOCUMENTS 4,922,958 5/1990 Lemp ..... 123/456 X

FOREIGN PATENT DOCUMENTS 58-144068 9/1983 Japan .

60-14276 1/1985 Japan .

*Primary Examiner*—Tony M. Argenbright

*Attorney, Agent, or Firm*—Wenderoth, Lind & Ponack

[57] ABSTRACT

A fuel delivery rail assembly for supplying fuel to a plurality of fuel injectors in an engine is provided. The assembly comprises an elongated conduit and a plurality of sockets. The conduit has a rectangular section consisting of a single plastic wall and three metallic walls. Opposing metallic walls are provided with cavities for receiving edges of the plastic wall. Abutment portions between the plastic wall and the metallic walls are mechanically shrinked from outside and combined tightly. Each of the sockets is integrally formed with the plastic wall.

2 Claims, 1 Drawing Sheet

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of fuel delivery rail assembly having a rectangular section is shown in FIG. 3 of the attached drawings In this assembly, an elongated conduit 11 is formed by a steel tube having a rectangular hollow section To an end of the conduit 11, a fuel inlet pipe 17 for introducing gasoline fuel is secured, and to the other end of the conduit 11, a fuel return pipe 18 leading to an exit for residual fuel is secured, both pipes being welded to the conduit by copper brazing. To the insides of the conduit 11 and the pipes 17, 18, copper plating is coated for protecting the surfaces from rust. At the intermediate portion of the conduit 11, four tubular sockets 14 are inserted into guide holes arranged within the bottom wall of the conduit 11 at predetermined intervals, and welded thereto by copper brazing These sockets 14 are so formed as to receive associated tips of fuel injectors. The axial directions of the sockets should precisely line up in alignment with the respective axial direction of the injectors. Furthermore, pitch lengths between adjacent sockets should precisely coincide with the corresponding pitch lengths between associated injectors. One of the objects of the present invention is directed to these alignment problems as discussed in detail below.

On the aforementioned copper plating portions, a further coating is needed for preventing copper ion from dissolving in the fuel. Therefore, after the copper brazing and coating, chemical plating (non-electrolytic plating) is applied to the all surfaces by coating thin metallic layers such as Ni-P or Sn. However, since the assembly is formed in a box shape, it takes a considerable time to let the plating liquid flow into the conduit and then drain away the conduit perfectly Furthermore, rotating action and up and down action of the conduit are needed for draining residual air and liquid during the plating steps Even if these actions are performed, it is difficult to eliminate plating defects caused by the remaining air and liquid. As a result, undesirable rust is originated from the plating defects. After the treatment, the residual plating liquid staying at the inside of the box-shape conduit, is carried back to a container for renewal, whereby a liquid degradation and consumption are accelerated, resulting in an increase of plating liquid supply or recirculation steps.

Referring to the sockets 14, especially interior surfaces thereof should be smoothly finished in order to establish a fluid tight seal of an O-ring after accommodating the respective fuel injector In manufacturing process of the metallic socket 14, many kinds of working steps are needed. For example, at first a rough fabrication is made by a forging work, and then it is machined to make a form of the interior surface. Finally, the socket is finished with a burnishing machine until the predetermined smoothness is obtained Under the situation, for making the socket 14 many kinds of time-consuming working steps and transferring handlings are needed, resulting in an increase of manufacturing cost.

In Japanese utility model public disclosure No. 144068/1983, there is disclosed an integral type fuel delivery rail assembly in which plastic sockets are molded integral with a plastic conduit through an injection molding process. However, it has been found that it is considerably difficult to make a mold and a block insert for the molding process. Moreover, since the assembly has poor rigidity, it is easily bent thereby causing fuel leakage or breakdown, which leads to a danger of fire.

In Japanese utility model public disclosure No. 14276/1985, there is disclosed another integral type fuel delivery rail assembly in which the plastic materials consist of fiberreinforced synthetic resin. However, it can not get rid of aforementioned drawbacks.

SUMMARY OF THE INVENTION

It is an object of the present invention to overcome the above disadvantages in producing the fuel delivery rail assembly and to reduce the number of working steps Another object of the present invention is to improve alignment problems in mounting of the fuel delivery rail assembly to an engine.

A further object of the present invention is to provide a lightweight fuel delivery rail assembly so as to reduce a resultant weight of an automotive engine.

Still further object of the present invention is to damp a generation of noise caused by a vibration of the fuel delivery rail assembly Still further object of the present invention is to improve the plating treatment of the conduit and to eliminate a generation of rust for obtaining high quality assembly.

According to the invention, there is provided a fuel delivery rail assembly for an internal combustion engine comprising; an elongated conduit having a fuel inlet at an end and a fuel exit at the other end, and a plurality of sockets so formed as to receive fuel injectors, the section of said conduit being formed in a generally rectangular hollow shape having four walls, one of said walls being made from plastic materials, and the other walls being integrally formed by metallic materials, opposing edges of said metallic walls being provided with cavities for receiving respective edges of said plastic wall, abutment portions between said plastic wall and said metallic walls being mechanically shrinked from outside thereby being tightly combined, each of said sockets being integrally formed with said plastic wall.

Within the scope of the invention, the rectangular section of the conduit is composed of a plastic wall and integral metallic walls Since all the sockets are formed with the plastic wall, they are precisely arranged in positions to be registered with the positions of the associated fuel injectors. Furthermore, misalignments of axial directions of the sockets are eliminated with the aid of flexibility of the plastic materials.

The plastic sockets can be made together with the wall to meet a required shape and surface smoothness through an injection molding process utilizing a metallic die. Thus, a smooth inside surface suitable for receiving a tip of a fuel injector can be accomplished easily. There is no need of complicated forging, machining, provisional spot welding, brazing and correcting steps which are needed in manufacturing of the conventional metallic socket.

In addition, plastic sockets can help to reduce a resultant weight of a fuel delivery rail assembly, thereby facilitating a reduction of an engine weight.

The flexibilities of the plastic wall and sockets can also help to damp a vibration of the fuel delivery rail assembly. As a result, a generation of noise is reduced.

As compared with the aforementioned integral type plastic assembly, according to the present invention, metallic walls of the conduit support a possible force from outside, whereby the rigidity of assembly is satisfactorily maintained. Undoubtedly, a mold for molding the flat wall and tubular sockets can be easily made through an ordinary process.

While the metallic portions of the conduit are plated and coated, they are separated from the plastic portion, whereby one side of the conduit is kept open. Residual air or liquid is not existing within the open conduit. Thus, the plating step can be easily performed and plating liquid can be saved. With a good selection of materials, electrolytic plating may be applied in the plating step so as to reduce time and cost for manufacturing In a preferable embodiment of the invention, the plastic wall with sockets is made from a glass-fiber reinforced polyamide resin and its surface is plated with nickel coating for the purpose of withstanding a high temperature and gasoline fuel.

Other features and advantages of the invention will become apparent from a reading of the specification, when taken in conjunction with the drawings, in which, like reference numerals refer to like elements in the several views.

DESCRIPTION OF THE PREFERRED EMBODIMENT

Figure 1:
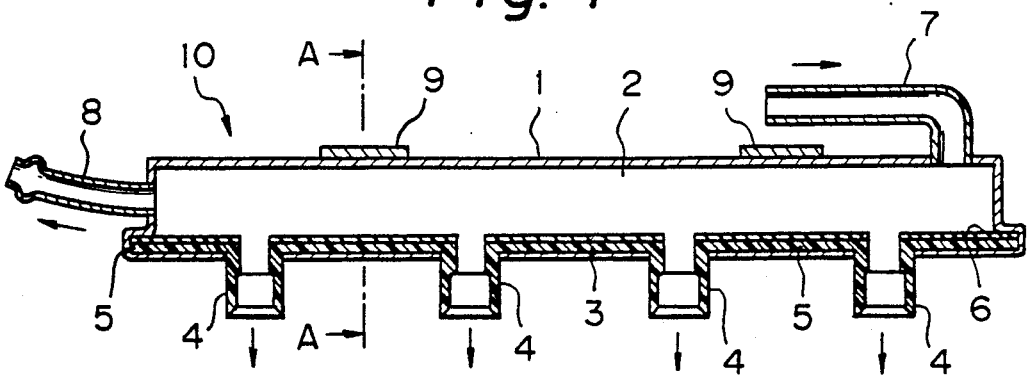
FIG. 1 is a vertical sectional view of the fuel delivery rail assembly according to the invention.

Referring to FIG. 1, there is shown a fuel delivery rail assembly 10, a preferable embodiment of the present invention, which is adapted to four cylinders on one side of an automotive V-8 engine. This assembly 10 comprises an elongated conduit 1 having a fuel inlet at an end and a fuel exit at the other end, and four sockets 4 attached to the bottom side of the conduit 1. The sockets 4 are disposed along the longitudinal direction of the conduit 1 at predetermined intervals so as to be registered with the positions of fuel injectors.

Figure 2:
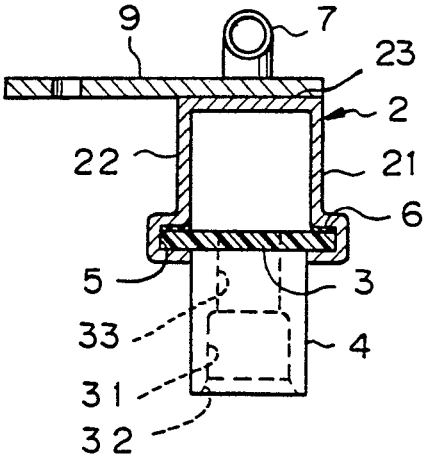
FIG. 2 is a vertical sectional view taken along the line A—A in FIG. 1.
Figure 3:
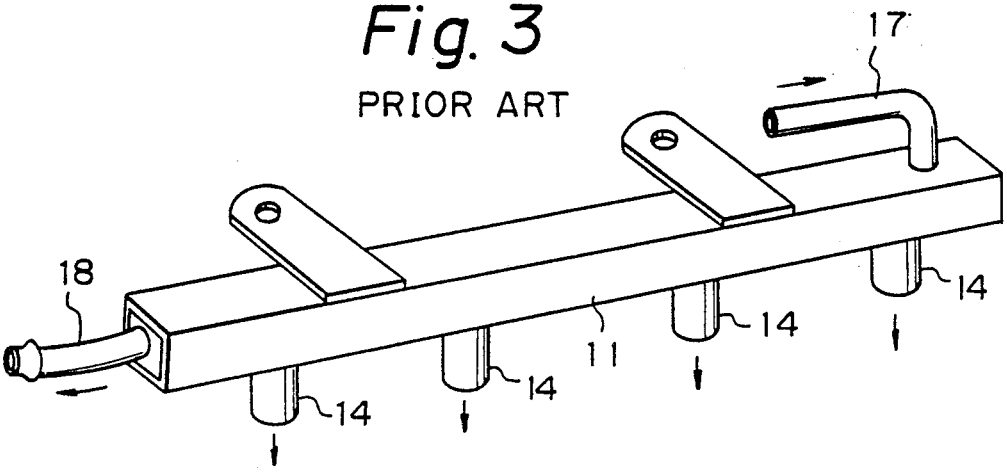
Fig. 3 PRIOR ART
FIG. 3 is a perspective view illustrating a conventional fuel delivery rail assembly.

As shown in the sectional view of FIG. 2, the section of the conduit 1 is formed into an essentially rectangular hollow shape having four walls, providing a fuel passage. Side walls 21 and 22, and upper wall 23 are integrally formed into a channel member 2, which can be produced by a process of steel plate roll forming or press working.

The flat bottom wall 3 is made from plastic materials integrally with the sockets 4, which are extending downward from the bottom surface of the wall 3. Opposing edges of the side walls 21 and 22 are bent outwardly and inwardly so as to form a cavity 5 within each edge. Inside of each cavity 5, a side edge of the flat wall 3 is inserted together with a seal member 6, and then abutment portions between the flat wall 3 and the metallic walls 21, 22 are mechanically shrinked from outside by means of working tools, thereby being tightly combined.

As shown in FIG. 1, the cavity 5 is also disposed at the distal ends of the elongated conduit 1 in order to establish a complete sealing around the periphery of the flat wall 3. Thus, the rectangular conduit 1 is composed of metallic materials and plastic materials.

To an end of the conduit 1, an inlet pipe 7 is fixed by brazing so as to connect with a pressure regulator or any other part leading to a fuel pressurizing pump, and to another end of the conduit 1, a return pipe 8 is fixed by brazing so as to receive a rubber hose for passing residual fuel to another fuel delivery rail assembly on the other side of the V-8 engine. Residual fuel is finally carried back to a fuel tank. To the upper side of the conduit 1, rigid brackets 9 are fixed so as to mount the assembly 10 on the engine.

Inside of the socket 4, are provided smooth interior surface 31 for receiving a body of an injector having O-ring thereon, a conical cut end surface 32 at the top opening, and a stepped bottom opening surface 33.

The sockets 4 and flat wall 3 are integrally made from plastic materials such as polyether-imide (PEI) resin or polyamide (PA) resin having superior properties of heatresistance and fuel-resistance, through an injection molding process utilizing a metallic die Thus, the interior surfaces are finished to obtain a required surface smoothness. The plastic materials are preferably reinforced by a glass-fiber or carbon-fiber in accordance with the required strength or other properties.

Plating treatment is applied to a sub-assembly comprising the metallic walls 21, 22, 23, the fuel inlet pipe 7, the fuel return pipe 8 and the brackets 9. This sub-assembly is not a box-shape, whereby the plating is easily performed without causing plating defects.

In the final assembly, the flat wall 3 is fixed within the cavity 5 disposed in the metallic walls. Under this condition, even if thermal expansion is caused, the flat wall 3 is held at the original position. Accordingly, sealing performance in the abutment portions is effectively maintained.

The seal member 6 can be selected from various materials. It is also possible to omit the seal member 6, as long as sealing performance is maintained without it.

Thus, as is apparent from the above description, the fuel delivery rail-assembly of the present invention can provide technical advantages as follows:

(a) Since many kinds of working and transferring steps can be saved, manufacturing process is considerably simplified (b) Since the sockets are integrally formed with the wall, the sockets are precisely arranged in their predetermined positions.

(c) Since there remains a flexibility for the axial direction of the socket due to the resiliency of the plastic materials, it becomes possible to make a practical adjustment between the socket and the injector.

(d) Since the plating treatment is applied to the sub-assembly, the quality of plating and coating is improved and a generation of rust is eliminated.

(e) Since a portion of the assembly is interchanged into a plastic part, the weight of the engine becomes smaller.

(f) Since the plastic materials can help to damp a vibration of the assembly, a generation of noise is reduced

I claim:

1. A fuel delivery rail assembly for an internal combustion engine comprising;

an elongated conduit having a fuel inlet at an end and a fuel exit at the other end, and a plurality of sockets so formed as to receive fuel injectors, the section of said conduit being formed in a generally rectangular hollow shape having four walls, one of said walls being made from plastic materials, and the other walls being integrally formed by metallic materials, opposing edges of said metallic walls being provided with cavities for receiving respective edges of said plastic wall, abutment portions between said plastic wall and said metallic walls being mechanically shrinked from outside thereby being tightly combined, each of said sockets being integrally formed with said plastic wall.

2. A fuel delivery rail assembly as claimed in claim 1, wherein said plastic wall with sockets is made from a glass-fiber reinforced polyamide resin and its surface is plated with nickel coating.

* * * * *